US005111667A

United States Patent [19]

Häfner et al.

[11] Patent Number: 5,111,667

[45] Date of Patent: May 12, 1992

[54] TWO-STAGE CRYOPUMP

[75] Inventors: Hans-Ulrich Häfner, Cologne; Hans-Hermann Klein, Friedberg; Uwe Timm, Frankfurt, all of Fed. Rep. of Germany

[73] Assignee: Leybold AG, Hanau, Fed. Rep. of Germany

[21] Appl. No.: 663,130

[22] Filed: Mar. 4, 1991

[30] Foreign Application Priority Data

Mar. 3, 1990 [DE] Fed. Rep. of Germany ..... 4006755

[51] Int. Cl.[5] ..... B01D 8/00

[52] U.S. Cl. ..... 62/55.5; 55/269; 62/268; 417/901

[58] Field of Search ..... 62/55.5, 100, 268; 417/901; 55/269

[56] References Cited

U.S. PATENT DOCUMENTS

| | | | |
|---|---|---|---|
| 2,465,229 | 3/1949 | Hipple, Jr. | 62/55.5 |
| 2,985,356 | 5/1961 | Beecher | 62/55.5 |
| 3,024,009 | 3/1962 | Booth, Jr. et al. | 62/55.5 |
| 4,438,632 | 3/1984 | Lessard et al. | 62/55.5 |
| 4,454,722 | 6/1984 | Bartlett et al. | 62/55.5 |
| 4,910,965 | 3/1990 | Lepofsky et al. | 62/55.5 |
| 4,918,930 | 4/1990 | Gaudet et al. | 62/55.5 |

FOREIGN PATENT DOCUMENTS 3512614 10/1986 Fed. Rep. of Germany .

*Primary Examiner*—Ronald C. Capossela

*Attorney, Agent, or Firm*—Specner, Frank & Schneider

[57] ABSTRACT

A two-stage cryopump having a refrigerator including a first stage and a second stage being colder than the first stage; a condensation member having a condensation surface; a first coupler for connecting the condensation member to the second stage in a thermally conducting manner; an adsorption member having an adsorption surface and being spaced from the condensation member; and a second coupler for connecting the adsorption member to the second stage in a heat conducting manner. There is further provided a heater for heating the adsorption member during time periods for regenerating the adsorption member. The second coupler is so designed that it thermally sufficiently insulates the adsorption member from the second stage and from the condensation member at least during heating periods of the adsorption member, for preventing heating the condensation member by the heater.

18 Claims, 2 Drawing Sheets

TWO-STAGE CRYOPUMP

CROSS REFERENCE TO RELATED APPLICATION

This application claims the priority of German application No. P 40 06 755.6 filed Mar. 3rd, 1990, which is incorporated herein by reference.

BACKGROUND OF THE INVENTION

This invention relates to a two-stage cryopump, including condensation and adsorption surfaces which are associated with the second (colder) stage. A two-stage cryopump of this type is known and is disclosed, for example, in German Offenlegungsschrift (application published without examination) 35 12 614.

Two-stage cryopumps are conventionally driven by a two-stage refrigerator constituting the cooling source. The first stage of the refrigerator has a temperature of 60–100K. The pumping faces (such as a radiation screen for the second stage) coupled to the first stage in a good heat conducting manner preferably serve for collecting thereon, by condensation, gases like water vapor, carbon dioxide and the like.

At the second stage of the refrigerator, which, during operation, has a temperature of approximately 10–20K, further pumping faces are provided which have directly and indirectly accessible zones. The directly accessible zone serves preferably for the removal of gases such a nitrogen, argon and the like by condensation. The indirectly accessible zone is provided for removing light gases such as hydrogen and helium by adsorption. Such an indirectly accessible pumping face zone is conventionally coated with an adsorption material, for example, active carbon.

In known cryopumps the capacity of the adsorbing pumping faces of the second stage is relatively small as compared to the capacity of the condensing pumping faces of the second stage. When such cryopumps are used in sputtering systems in which large hydrogen quantities are used, there is thus often encountered the disadvantage that the adsorption capacity is exhausted long before the condensating capacity. It is then necessary to regenerate the adsorption surfaces which is effected by energizing a heater associated with the second stage. In this manner the stage itself as well as the pumping faces are heated. A temperature increase to at least 70K, preferably 90K is necessary to achieve a complete regeneration of the adsorption surfaces. Since the condensation surfaces of the second stage too, assume such a higher temperature, it is unavoidable that condensatable gases such as argon are vaporized which thus takes place simultaneously with the regeneration of the condensation faces of the second stage.

If the regenerating process is stopped immediately after the complete regeneration of the adsorption surfaces (which only takes a short period of time) and the re-cooling of the pumping faces of the second stage is commenced, then the condensation surfaces of the second stage are not yet fully regenerated. Since the adsorption material, preferably active carbon, has still a good adsorption probability for the above-noted condensatable gases (for example, argon) at the higher temperatures in the range of 70–90K, such gases may drift at these elevated temperatures from the condensation faces onto the adsorption faces. Thus such condensatable gases occupy already in the re-cooling phase the active carbon and therefore adversely affect the adsorption capacity of the adsorbing material for light gases for which the adsorption capacity of the adsorbing material should have been reserved in the first place. In order to avoid such an adverse effect in the known cryopumps, it is necessary to carry out a time-consuming regenerating process for both pumping faces of the second stage even if only the adsorption capacity was exhausted, although such a process for the condensation surfaces would have been necessary only after a long period of time.

SUMMARY OF THE INVENTION

It is an object of the invention to provide an improved two-stage cryopump of the above-outlined type which makes possible a partial regeneration of the pumping faces of the second stage such that only the adsorption faces for light gases such as hydrogen, helium and the like are regenerated.

This object and others to become apparent as the specification progresses, are accomplished by the invention, according to which, briefly stated, the adsorption surfaces are disposed on a separate, heatable component which, at least for the duration of heating, is sufficiently thermally insulated from the second stage of the refrigerator for preventing heating of the condensation faces of the second stage.

According to a preferred embodiment of the invention, the component which carries the adsorption faces is thermally switchable between two positions such that in the first position (during normal pumping operation) the component is in a good heat conducting contact with the second stage of the refrigerator, whereas in the second position (during regeneration) the component is thermally insulated from the second stage of the refrigerator. In the configuration of the pumping faces of the second stage according to this embodiment, the regeneration of the adsorption faces may be performed when the adsorption faces have no thermal contact with the second stage of the refrigerator, that is, they are out of thermal contact with the condensation surfaces of the second stage. During regeneration of the adsorption faces thus a disadvantageous temperature increase of the condensation surfaces does not occur. A vaporization of the already condensed gases and thus an undesired drifting thereof are avoided. This embodiment requires mechanical switching devices or thermal switches which have to be actuated externally of the pump.

According to another preferred embodiment of the invention, no mechanical or electric switching means are needed. According to such a second preferred embodiment, the adsorption faces are situated on a heatable component which is separated from the second stage — and is thus separated from the condensation surfaces of the second stage — by a thermal resistor having an inferior heat conducting property. This embodiment of the pumping faces of the second stage too, makes possible to heat the adsorption faces to a temperature which regenerates these surfaces without causing a temperature increase of the condensation surfaces. During the relatively short-period regeneration of the adsorption faces, the thermal resistor prevents the condensation faces from warming up to the temperatures which would result in a vaporization of the condensed gases. Since, during normal operation of the cryopump, the adsorption faces are not exposed to a high thermal stress, the influence of the thermal resistor on the adsorption properties is negligible.

Both above-noted embodiments make possible a partial regeneration affecting only the adsorption surfaces. Such a regeneration requires only a short period of time because, on the one hand, the desorption of the light gases proceeds relatively rapidly and, on the other hand, the second stage itself need not be heated at the same time. The invention therefore results in a substantial postponement of the rarely needed, time-consuming regenerating process for the entire pump.

DESCRIPTION OF THE PREFERRED EMBODIMENTS

Figure 1:
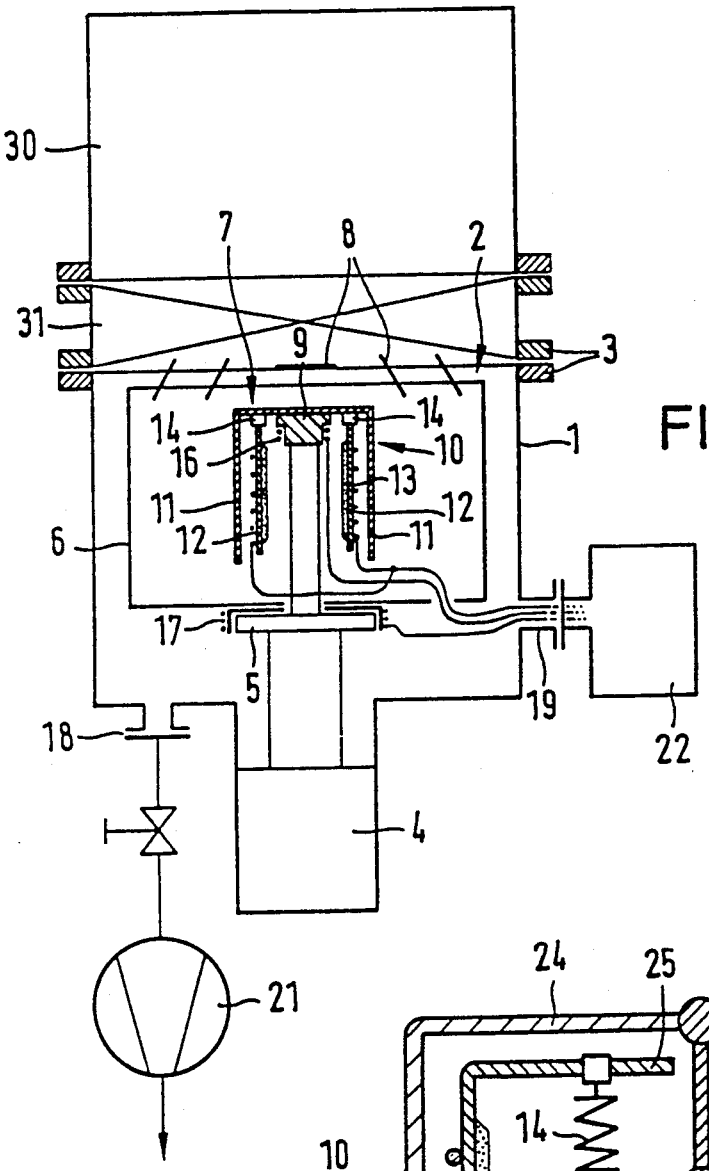
FIG. 1 is a schematic elevational view of a two-stage cryopump according to a preferred embodiment of the invention.

The two-stage cryopump illustrated in FIG. 1 has a housing 1 provided with an inlet opening 2 for the gases to be removed. To the flange 3 of the housing 1 there is secured a vessel 30 to be evacuated, with the interposition of a shutoff device 31.

A two-stage refrigerator 4 projects into the housing 1 from below. A bowl-shaped shield 6 is secured with a good thermal contact to a first stage 5 of the refrigerator 4. The shield 6 has a top opening 7 which has a plane disposed approximately parallel to the inlet 2 of the housing 1. Metal baffle strips 8 are held in the opening 7. The shield 6 and also the baffle strips 8 serve as pumping surfaces for gases such as water vapor, carbon dioxide and the like. A second stage 9 of the refrigerator 4 extends into the shield 6 from below. The second stage 9 carries the pump surfaces 10 of the second stage. They comprise a total of four, substantially parallel-arranged sheet metal plates (made, for example, of copper) oriented perpendicularly to the plane of the inlet opening 2. The two external sheet metal plates are designated at 11, whereas the two internal sheet metal plates are designated at 12. The outer plates 11 are connected directly to the second stage 9 of the refrigerator 4, that is, they are connected with good thermal contact and constitute the condensation pumping faces of the second stage.

The inner sheet metal plates 12 are provided on their respective inwardly-oriented face with an active carbon layer 13, each forming the adsorption pumping faces of the second stage. These adsorption pumping faces are coupled with the second stage 9 of the refrigerator 4 by means of schematically illustrated thermal resistors 14 (that is, components which have a predetermined heat flow resistance) Further, the adsorption faces 13 are heatable; for this purpose foil heating elements 15 are arranged in contact with the metal plates 12. Both stages 5 and 9 of the refrigerator 4 are provided with further heaters 16 and 17, with the aid of which a regeneration of the entire pump may be carried out.

The housing 1 of the cryopump has a coupling nipple 18 to which a pre-vacuum pump 21 is connected. The housing 1 has a further coupling nipple 19 which, in turn, serves for the passage of current conductors to the heaters 15, 16 and 17. The coupling nipple 19 furthermore serves for supporting a control device 22, by means of which the heaters 15, 16 and 17 are operated.

Figure 2:
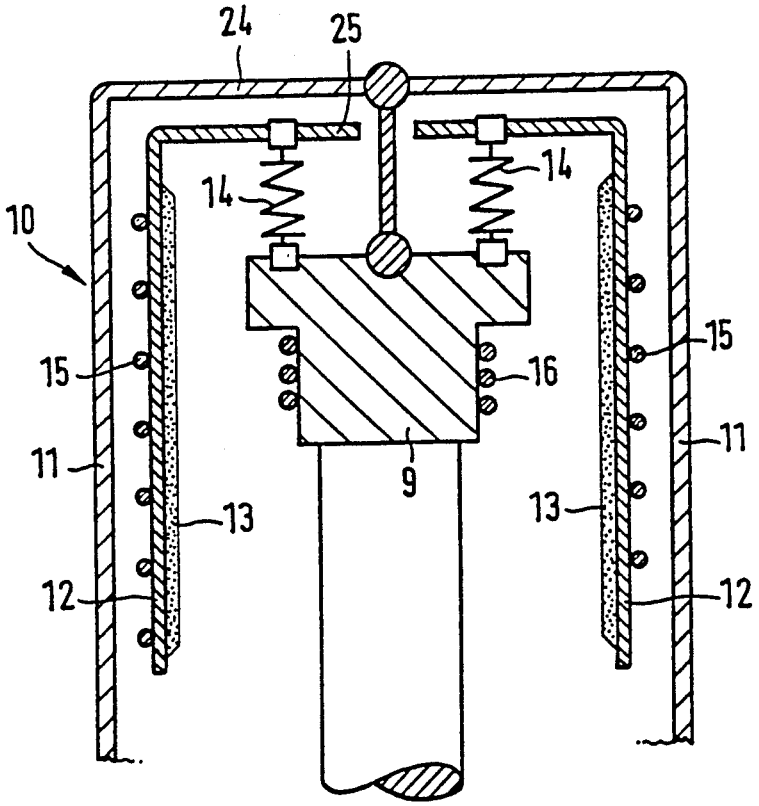
FIG. 2 is a sectional elevational view, on an enlarged scale, of one part of the construction shown in FIG. 1.

FIG. 2 illustrates the operating principle of the invention. It is of importance that between the condensating pumping faces 11 and the second stage 9 of the refrigerator a good thermal contact is provided, whereas the adsorption pumping faces are coupled with the second stage 9 by thermal resistors 14 having a predetermined thermal resistance (resistance to heat flow). The resistance of the thermal resistors 14 is designed such that the relatively short-period regeneration of the adsorption layer 13 may be effected by heating the metal plates 12 with the aid of the heater 15 without the temperature increase of the adsorption surfaces having an appreciable influence on the second stage 9 and thus on the condensation faces 11. The regeneration process of the adsorption faces has to be concluded before the condensation faces 11 vaporize the gases condensated thereon. These considerations are determinative for the lower limit of the heat resistance value of the thermal resistors 14. As to the upper limit of the heat resistance of the thermal resistors 14, it is an important consideration that a sufficient and secure cooling of the adsorption faces 12, 13 has to be carried out during the normal operation of the cryopump. Since the adsorption faces 12, 13 are not significantly stressed thermally during the normal operation, the presence of high thermal resistances for the thermal resistors 14 does not have a disadvantageous effect. The presence of the thermal resistors 14 has merely the effect that the adsorption faces 13 reach their operational temperature in a delayed manner after start-up or after a total regeneration process. Such a delay, however, is, as a rule, desirable since in this manner an early deposition of undesired gases on the adsorption faces 13 is avoided.

Figure 3:
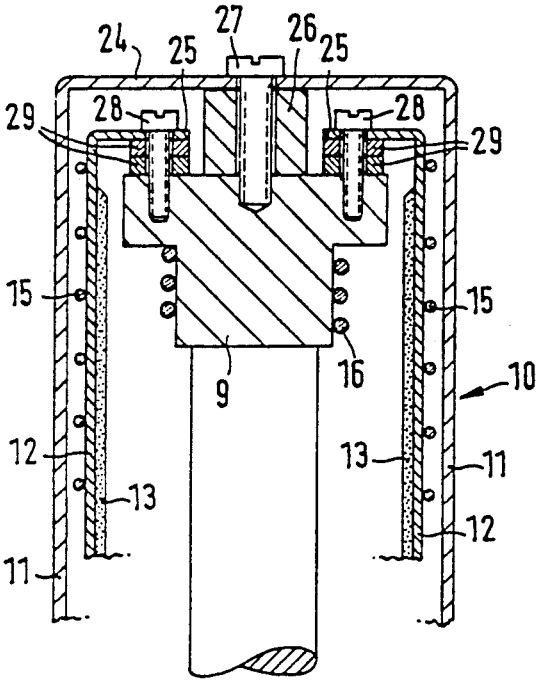
FIGS. 3 and 4 are sectional elevational views, similar to FIG. 2, of two further preferred embodiments of the invention.

In the embodiment according to FIG. 3, the angled portions 24 of the condensation faces 11 contact the second stage 9 of the refrigerator 4 with the intermediary of a highly heat conducting block 26 (made, for example, of copper). By means of a screw 27, also made of a good heat conducting material, the pumping faces 11 and the copper block 26 are secured to the central zone of the second stage 9. The adsorption plates 12 are secured laterally adjacent the copper block 26 to the second stage 9, by means of screws 28 and washers 29 made of a poorer heat conductor (such as high-grade steel) than the block 26. In this manner a sufficiently high heat flow resistance is provided between the plates 12 and the second stage 9.

Figure 4:
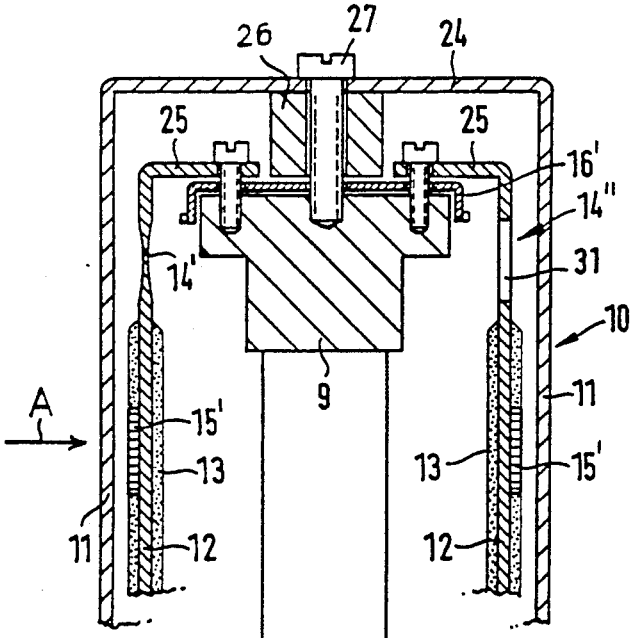
Figure 5:
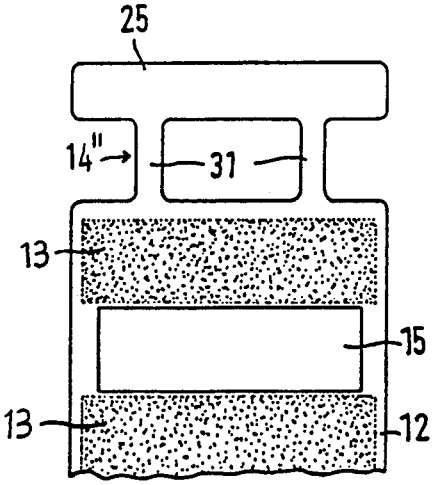
FIG. 5 is an elevational view of a component of the structure shown in FIG. 4, as viewed in the direction of arrow A.

Turning to the embodiment illustrated in FIGS. 4 and 5, the heater 16' of the second stage 9 is formed of a heating plate which is positioned between the copper block 26 and the second stage 9. FIG. 4 shows two further alternatives for the heat flow resistances. Thus, the thickness of the left-hand sheet metal plate 12 is reduced between the adsorbing zone 13 and the second cold stage 9. In this manner, a thermal resistor 14' is provided: the plate cross section determining the heat conductivity is significantly less so that a sufficiently large heat flow resistance is present. For the right-hand sheet metal plate 12 the cross-sectional reduction is effected between the angled portion 25 and the pumping face 13 by the provision of relatively narrow connecting webs 31, thus constituting a thermal resistor 14".

A further difference between the embodiments of FIGS. 3 and 4 resides in the fact that in the latter, the heaters 15' contacting the outwardly-oriented faces of the adsorption plates 12, that is, those faces which are oriented toward the condensation plates 11 are structured as foil heater elements and that the remaining zones of the outwardly-oriented faces of the plates 12 are coated with layers 13 of an adsorption material. In this manner, the adsorption capacity of the plate 12 is increased.

Figure 6:
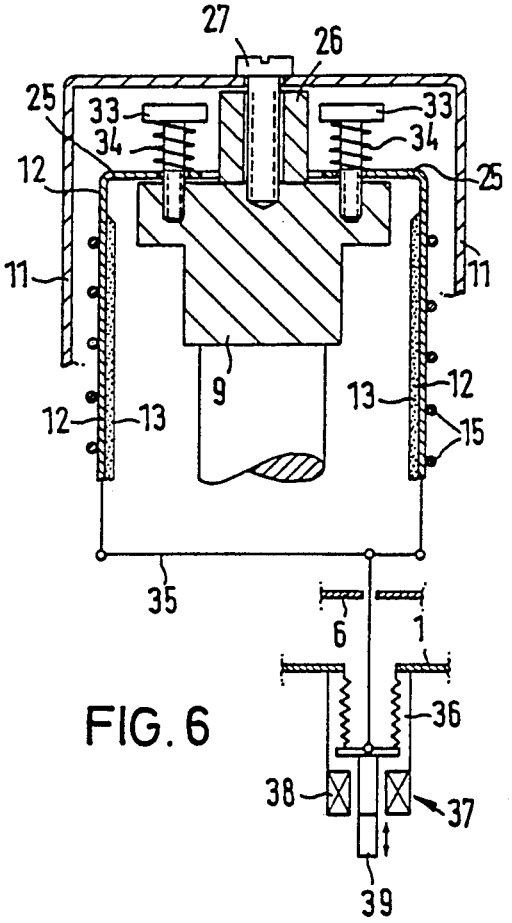
FIG. 6 is a sectional elevational view, similar to FIG. 2, of still another preferred embodiment of the invention.

Turning now to the embodiment illustrated in FIG. 6, in this construction a mechanical solution is provided. The condensation plates 11 are, as in the other embodiments, firmly coupled to the second (cold) stage 9 by means of the copper block 26. The adsorption plates 12 are secured to the second stage 9 by mounting screws 33 and are resiliently pressed into a direct contact with the second stage 9 by coil springs 34.

A linkage system 35 is connected to the adsorption plates 12 and is passed outwardly through the shield 6 and, by means of a spring bellows 36, is attached in a vacuumtight manner to the outside of the pump housing 1. Externally of the pump there is provided a drive 37 which, as shown schematically in FIG. 6, is a magnetic drive having a solenoid 38 and an armature 39 connected with the linkage mechanism 35. Upon energization of the drive 37, the linkage system 35 lifts the adsorption plates 12 off the cold stage 9, whereby a thermal separation of the plates 12 from the cold stage 9 is achieved. In such a separated position the desired separate regeneration of the adsorption faces 12 may be carried out without an appreciable effect on the other pumping faces.

Instead of the illustrated drive 37, other drives may be used to move the adsorption plates 12, such as a motor driven eccentric, an electromagnet drive, a bimetal switch, a pneumatic device which may be self-regulated by the vapor pressure of an appropriate fluid, such as $LH_2$. Upon proper selection of materials, the drive 37 may be situated within the pump. It is a precondition for a bimetal drive that the desired configurational changes which effect coupling and uncoupling, occur at temperatures which prevail in the zone of the adsorption plates 12.

It will be understood that the above description of the present invention is susceptible to various modifications, changes and adaptations, and the same are intended to be comprehended within the meaning and range of equivalents of the appended claims.

What is claimed is:

1. In a two-stage cryopump having a refrigerator including a first stage and a second stage being colder than the first stage; a condensation member having a condensation surface; first coupling means for connecting said condensation member to said second stage in a thermally conducting manner; an adsorption member having an adsorption surface and being spaced from said condensation member; and second coupling means for connecting said adsorption member to said second stage in a thermally conducting manner; the improvement comprising heating means for heating said adsorption member during time periods for regenerating said adsorption member; further wherein said second coupling means comprises means for thermally insulating said adsorption member from said second stage and from said condensation member at least during heating periods of said adsorption member by said heating means for preventing heating said condensation member by said heating means.

2. A two-stage cryopump as defined in claim 1, wherein said means for thermally insulating said adsorption member comprises a movable member having a first position in which a thermal contact of superior heat conductivity between said adsorption member and said second stage is maintained and a second position in which said adsorption member is thermally separated from said second stage.

3. A two-stage cryopump as defined in claim 2, further comprising means for movably supporting said adsorption member; said adsorption member constituting said movable member.

4. A two-stage cryopump as defined in claim 3, further comprising moving means for displacing said adsorption member selectively into said first or second positions.

5. A two-stage cryopump as defined in claim 4, wherein said moving means comprises a spring arranged for resiliently urging said adsorption member into said first position and drive means for displacing said adsorption member into said second position against a force exerted by said spring.

6. A two-stage cryopump as defined in claim 5, wherein said two-stage pump comprises a pump housing; further wherein said drive means comprises an energizable drive arranged externally of said pump housing and a linkage mechanism connecting said energizable drive with said adsorption member.

7. A two-stage cryopump as defined in claim 1, wherein said means for thermally insulating said adsorption member comprises a thermal resistor.

8. A two-stage cryopump as defined in claim 7, wherein said thermal resistor is of a material having an inferior heat conductivity.

9. A two-stage cryopump as defined in claim 8, wherein said material is a high-grade steel.

10. A two-stage cryopump as defined in claim 7, wherein said thermal resistor is formed of a reduced thickness of said adsorption member.

11. A two-stage cryopump as defined in claim 7, wherein said thermal resistor is formed of a reduced cross-sectional area of said adsorption member between said second stage and said adsorption surface.

12. A two-stage cryopump as defined in claim 11, wherein said resistor is formed of a web of said adsorption member.

13. A two-stage cryopump as defined in claim 1, wherein said first coupling means is formed of a material having a superior heat conductivity.

14. A two-stage cryopump as defined in claim 13, wherein said first coupling means comprises a copper block.

15. A two-stage cryopump as defined in claim 1, further comprising means defining a pump inlet opening; further wherein said condensation member comprises two parallel-arranged, spaced condensation plates and said adsorption member comprises two parallel-arranged, spaced adsorption plates; said condensation plates being parallel to, spaced from and flanking said adsorption plates; said condensation plates and said adsorption plates being oriented perpendicularly to said pump inlet opening; said condensation plates having outwardly-oriented faces constituting condensation surfaces; said adsorption plates having inwardly-oriented faces carrying adsorption surfaces.

16. A two-stage cryopump as defined in claim 15, wherein each inwardly-oriented face of the adsorption plates is provided with a layer of adsorption material.

17. A two-stage cryopump as defined in claim 16, wherein said adsorption plates having outwardly-oriented faces carrying adsorption surfaces each being provided with a layer of adsorption material.

18. A two-stage cryopump as defined in claim 15, wherein each condensation plate and each adsorption plate has an angled flange portion connected with the respective said first and second coupling means.

* * * * *